US006454203B1

(12) United States Patent
Hashimoto et al.

(10) Patent No.: US 6,454,203 B1
(45) Date of Patent: Sep. 24, 2002

(54) YARN WINDER WITH VIBRATION DAMPER

(75) Inventors: Kinzo Hashimoto, Kyoto; Takanori Ogata, Takatsuki, both of (JP)

(73) Assignee: Murata Kikai Kabushiki Kaisha, Kyoto (JP)

( * ) Notice: Subject to any disclaimer, the term of this patent is extended or adjusted under 35 U.S.C. 154(b) by 0 days.

(21) Appl. No.: 09/657,066

(22) Filed: Sep. 7, 2000

(30) Foreign Application Priority Data

Sep. 10, 1999 (JP) ..... 11-257224

(51) Int. Cl.[7] ..... B65H 67/048; B65H 54/42
(52) U.S. Cl. ..... 242/474.6; 242/486.1
(58) Field of Search ..... 242/474.6, 477, 242/486.1; 188/379

(56) References Cited

U.S. PATENT DOCUMENTS 3,617,009 A * 11/1971 Lawson et al. ..... 242/477
3,733,034 A * 5/1973 Allam et al. ..... 242/477
4,114,819 A * 9/1978 Kanki et al. ..... 242/486.6
4,342,429 A * 8/1982 Katoh et al. ..... 242/486.2
4,903,905 A * 2/1990 Hasegawa et al. ..... 242/470
5,056,763 A * 10/1991 Hamada et al. ..... 188/379 X
6,308,810 B1 * 10/2001 Kuwayama ..... 188/379

FOREIGN PATENT DOCUMENTS

JP 8-208117 8/1996

* cited by examiner

*Primary Examiner*—Michael R. Mansen
*Assistant Examiner*—Minh-Chau Pham
(74) *Attorney, Agent, or Firm*—Armstrong, Westerman & Hattori, LLP

(57) ABSTRACT

The present invention provides yarn winder that can provide a vibration suppressing function for the yarn winder over a long period despite minor differences in vibration characteristic among individual yarn winders. A vibration suppressing device is provided in a yarn winder comprising rotatable bobbin holders 105 and 106 supported on a body frame 102, the bobbin holders each having bobbins installed thereon and around which packages P are formed. The vibration suppressing device comprises an impact damper 10 comprising a mass body 11 and a regulation member 13 for holding the mass body 11 in such a manner as to have degrees of freedom. The impact damper 10 is provided in a site that vibrates as the bobbin holders 105 and 106 rotate, for example, at a tip of an elevating bracket 109.

8 Claims, 8 Drawing Sheets

YARN WINDER WITH VIBRATION DAMPER

FIELD OF THE INVENTION

The present invention relates to a yarn winder comprising rotatable bobbin holders supported on a body frame, the bobbin holders each having bobbins installed thereon and around which packages are formed, and in particular, to a yarn winder that can suppress its own vibration.

BACKGROUND OF THE INVENTION

A representative example of a yarn winder of this kind is a take-up winder. The take-up winder comprises rotatable bobbin holders supported in such a manner as to project from a body frame, the bobbin holders each having bobbins installed thereon and around which packages are formed, and a bracket supported in such a manner as to project from the body frame and holding a roller that rotates in contact with the package, wherein the interval between the bobbin holder and the roller can be varied. By rotationally driving either the roller or the bobbin holder, the package is formed on the bobbin in such a manner as to grow gradually thicker. Since a yarn is wound at a constant winding speed, the rotation speed of the roller in contact with the package is constant. As the package grows thicker and thicker, the rotation speed of the bobbin holder decreases. At the same time, the interval between the bobbin holder and the roller widens.

In such a take-up winder, the bobbin holder, which rotatably holds the massive package, vibrates and the vibration is transmitted to the roller which is in contact with the package and the body frame, thereby vibrating the entire take-up winder. The rotational frequency of the bobbin holder decreases with an increase in the size of the package. Alternatively, the rotational frequency increases consistently with a winding speed of the take-up winder. Take-up winders are required to accommodate larger packages and to wind a yarn at a higher speed, so that recent take-up winders cover a wide range of rotational frequencies. Under these circumstances, a winding operation is performed in such a manner as to slowly traverse the natural frequency of the take-up winder, thereby causing the winder to vibrate.

Vibration suppressing devices are used to suppress this vibration. A vibration suppressing device has been proposed which uses a dynamic vibration reducer attached to a neighborhood of a tip of the above described bracket. The dynamic vibration reducer is constructed by combining a viscoelastic material and a mass. By setting the resonance frequency of the dynamic vibration reducer equal to a neighborhood of the resonance frequency of the take-up winder, the resonance of the take-up winder is suppressed.

Due to differences among individual take-up winders and temporal changes, however, the resonance frequency of the take-up winder is inconstant. On the other hand, the resonance frequency of the dynamic vibration reducer is determined by the viscoelastic material and the mass. It is thus difficult to equalize the resonance frequency of the take-up winder with that of the dynamic vibration reducer. When the characteristics of the take-up winder do not match those of the dynamic vibration reducer, heavy vibration may occur. In addition, since the dynamic vibration reducer has a viscoelastic material such as rubber, temporal changes in rubber change the frequency characteristic of the dynamic vibration reducer in such a manner that its frequency deviates gradually from the resonance frequency of the take-up winder, resulting in an increase in the vibration of the take-up winder. Thus, it is difficult to set and manage the characteristics of the take-up winder and the dynamic vibration reducer so that the dynamic vibration reducer is effective on the take-up winder. Even if a vibration suppressing function can be provided during a short period, maintaining this function during a long-term operation is in fact difficult.

The present invention is provided in view of these problems, and it is an object thereof to provide a yarn winder having a vibration suppressing device that can provide a vibration suppressing function for the yarn winder over a long period despite minor differences in vibration characteristic among individual yarn winders.

SUMMARY OF THE INVENTION

The present invention that attains the above object is a yarn winder comprising rotatable bobbin holders supported on a body frame, the bobbin holders each having bobbins installed thereon and around which packages are formed, the yarn winder being characterized in that an impact damper comprising a mass body and a regulation member for holding the mass body in such a manner as to have degrees of freedom is provided in a site that vibrates as the bobbin holder is rotated.

The mass body and regulation member of the impact damper collide against each other to convert vibration energy into thermal energy for absorption, so that even if a vibration characteristic of the impact damper does not match that of the yarn winder, the impact damper can absorb vibration as long as the vibration is heavy. Thus, when the impact damper is provided in a site of the yarn winder where heavy vibration occurs and where the damper is easily mounted, vibration is continuously suppressed as long as it is heavy. It is important that the mass body operates separately from the vibration of the yarn winder.

The present invention is a yarn winder wherein the degrees of freedom of the mass body are provided in a plane perpendicular to a rotational axis of the bobbin holder.

In the yarn winder comprising the rotatable bobbin holders supported on the body frame, the bobbin holders each having the bobbins installed thereon and around which the packages are formed, heavy vibration occurs in the plane perpendicular to the rotational axis of the bobbin holder. Accordingly, when the degrees of freedom of the mass body are provided in this plane, vibration energy is efficiently absorbed. This configuration is particularly effective if the bobbin holder is supported in such a manner as to project from the body frame.

The present invention is a yarn winder, characterized in that the mass body is held on the regulation member at its centroidal position.

When the mass body is held on the regulation member at its centroidal position, the impact damper functions effectively to enhance a vibration suppressing effect.

Alternatively, the mass body preferably holds the regulation member in such a manner as to have degrees of freedom in a plurality of directions. This is because the vibration does not always occur in a constant direction because the yarn winder vibrates due to a combination of complicated factors. For example, by forming a ring-shaped gap between the mass body and the regulation member, the plurality of degrees of freedom can be easily provided for the mass body.

Alternatively, an elastic body may be provided to reduce impact sounds. In this case, the elastic body must also be interposed between the mass body and the regulation member so that the mass body can collide against the regulation member.

Alternatively, the impact damper is preferably provided at a tip of the bobbin holder. If the yarn winder has a touch roller in contact with the bobbin holder via the package and a bracket supporting the touch roller is supported in such a manner as to project from the body frame, then the impact damper is preferably provided on a tip surface of the bracket because this arrangement enhances the vibration suppressing effect.

DETAILED DESCRIPTION OF THE PREFERRED EMBODIMENTS

Embodiments of the present invention will be described with reference to the drawings.

Figure 1:
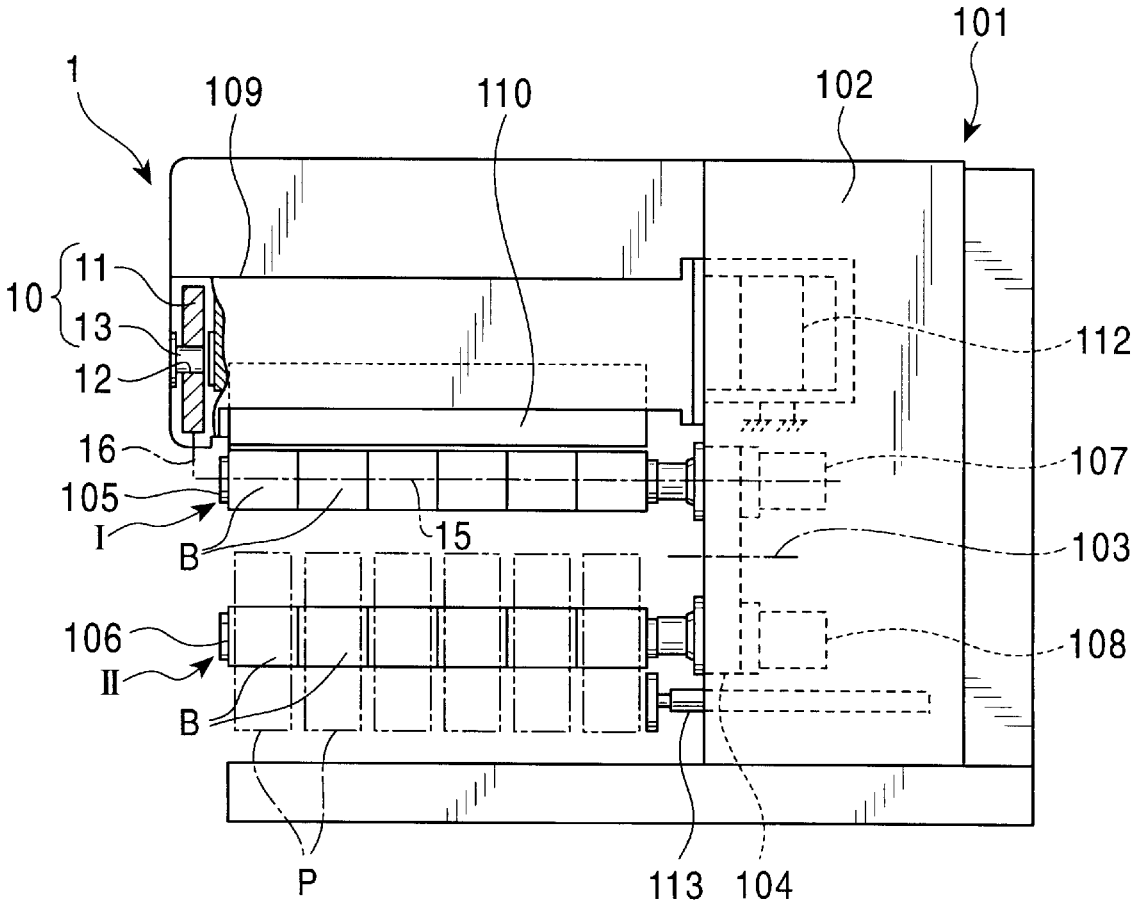
FIG. 1 is a side view of a take-up winder that is an embodiment of a yarn winder.
Figure 2:
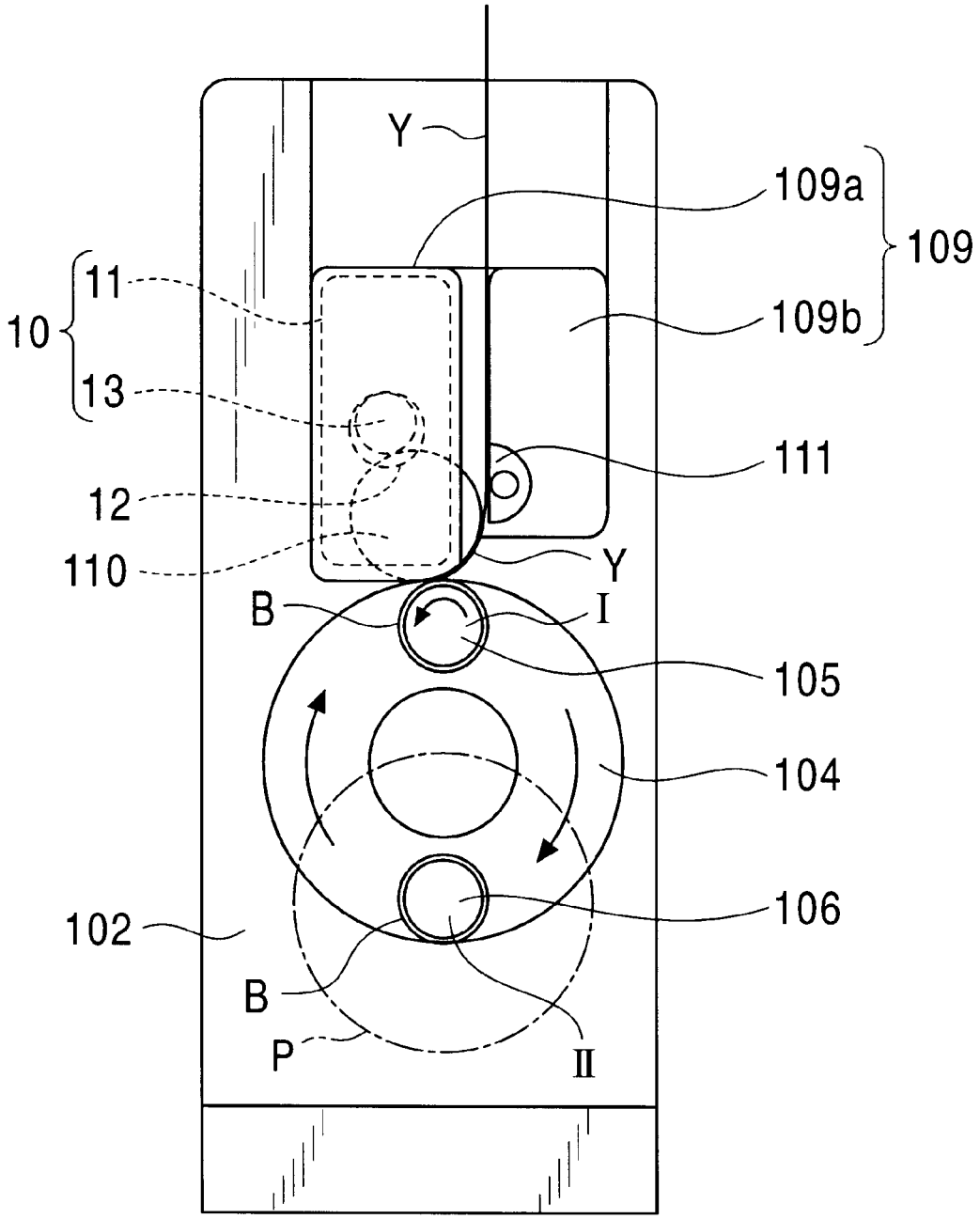
FIG. 2 is a front view of the take-up winder in FIG. 1 upon yarn transfer.

In FIGS. 1 and 2, a vibration suppressing device 1 is constructed by installing an impact damper 10 at a tip of an elevating bracket 109 of a take-up winder 101. The impact damper 10 comprises a rectangular plate 11 acting as a mass body, and a shaft 13 passed through a hole 12 formed at a centroid of the rectangular plate 11, to function as a regulation member.

The hole 12 has an inner diameter larger than the outer diameter of the shaft 13, so that there is a predetermined gap between the hole 12 and the shaft 13. Accordingly, the rectangular plate 11 has appropriate degrees of freedom for moving in all directions in a plane 16 perpendicular to a rotational axis 15 of a bobbin holder 105. To ensure the degrees of freedom, the vibration suppressing device 1 has appropriate locking means such as an end plate for preventing the shaft 13 from slipping out from the rectangular plate 11 and appropriate detent means such as a stopper for preventing the rectangular plate 11 from rotating around the shaft 13.

Next, an example of the structure of the take-up winder 101 having the impact damper 10 installed therein will be explained.

The take-up winder 101 is based on a turret method for swiveling bobbin holders projected from a turret plate in order to transfer a yarn and on a spindle method for rotationally driving the bobbin holders.

The take-up winder 101 comprises a turret plate 104 that is swiveled around a horizontal axis 103 with respect to a body frame 102 by 180 degrees upon each movement, two bobbin holders 105 and 106 supported in such a manner as to project from the turret plate 104, induction motors 107 and 108 that are rotational driving means fixed to a rear side of the turret plate 104 to rotationally drive the bobbin holders 105 and 106, respectively, a touch roller 110 acting as a roller and supported in such a manner as to project from the body frame 102, the touch roller 110 being provided in the elevating bracket 109 that can be elevated and lowered in a vertical direction, and a traverse device 111 also provided in the elevating bracket 109. In this manner, the take-up winder 101 is structured to support the rotatable bobbin holders 105 and 106 and the touch roller 110 rotatably held in the elevating bracket 109 in such a manner that the bobbin holders 105 and 106 and the touch roller 110 project from the body frame 102.

The elevating bracket 109 has its load supported by a contact pressure cylinder 112 provided at a proximal end thereof. A differential pressure between the total weight of the elevating bracket 109 and a lifting force applied by the contact pressure cylinder 112 constitutes a contact pressure on a package P.

In FIG. 2, a filament yarn of synthetic fibers Y continuously spun from a melt spinning machine (not shown in the drawings) is traversed by the traverse device 111, passed through the touch roller 110, and then wound around a bobbin B installed on the bobbin holder 105 or 106. The illustrated example shows a state observed immediately after the yarn Y shown by an alternate long and two short dashes line has been transferred to the empty bobbin B at a winding position I, following the movement of the bobbin holder 106, which has become full, to a standby position II. The illustrated example also shows that six bobbins B are installed on a single bobbin holder 105 and that the yarn is wound around each of the bobbins B.

The above described take-up winder 101 rotationally drives the bobbin holders 105 and 106 in such a manner that the rotation speed of the touch roller 110 is constant, in order to obtain a substantially constant yarn tension or yarn winding speed. Thus, when the package P formed around the bobbin B of the bobbin holder 105 has grown thick, the rotation speed of the bobbin holder 105 decreases while the elevating bracket 109 rises. When the package P at the winding position I becomes full, the turret plate 104 is swiveled by 180 degrees to move the full package P to the standby position II while moving the empty bobbin B to the winding position I. As shown by the alternate long and two short dashes line in FIG. 2, the yarn Y can then be brought into contact with the empty bobbin B and wound into a full package P. Thus, a yarn transferring device (not shown in the drawings) transfers the yarn Y from the full package P to the empty bobbin B. Next, the rotation of the bobbin holder 106 at the standby position II is stopped, and a pusher device 113 pushes the full package P onto a doffing cart (not shown in the drawings), while an empty bobbin B is simultaneously inserted over the bobbin holder 106. These operations are repeated to continuously wind the yarn.

In the take-up winder structured as described above, the bobbin holder 105 projected from the body frame 102 via the turret plate 104 constitutes a principal exciting source. Since the yarn is wound at a constant speed, the rotation speed of the bobbin holder 105 decreases as the package P grows thicker. In addition, the winding speed of the take-up winder is set over a wide range from, for example, low-speed 500 m/min to high-speed 6,000 m/min. Consequently, the rotational frequency or rotation speed of the bobbin holder 105 varies over a wide range, so that a winding operation may be performed in such a manner as to traverse the primary or secondary natural frequency of the take-up winder. In such a case, vibration of the bobbin holder 105 is transmitted to the touch roller 110 via the package P to vibrate the entire take-up winder 101 through the elevating bracket projected from the body frame 102.

As shown in FIG. 2, the elevating bracket 109 comprises a first bracket 109*a* rotatably holding the touch roller 110 and a second bracket 109*b* holding the traverse device 111 for traversing the yarn Y, the first bracket 109*a* and the second bracket 109*b* being arranged in parallel and projected from the body frame 102. A space can be easily provided at a tip of the first bracket 109*a* or the second bracket 109*b*. Thus, the impact damper 10 is preferably provided at the tip of the first bracket 109*a* or/and the second bracket 109*b* In particular, the impact damper 10 is most preferably provided at the tip of the first bracket 109*a* because this first bracket 109*a* holds the touch roller 110, which is subjected to vibration from the bobbin holder 105.

The first bracket 109*a* vibrates chiefly in a direction joining a central axis of the bobbin holder 105 with a central axis of the touch roller 110. This vibration causes the rectangular plate 11 to vibrate in the same direction to repeat a collision between an inner circumference of the hole 12 and an outer circumference of the shaft 13. This collision converts vibration energy into thermal energy to suppress vibration.

Figure 3:
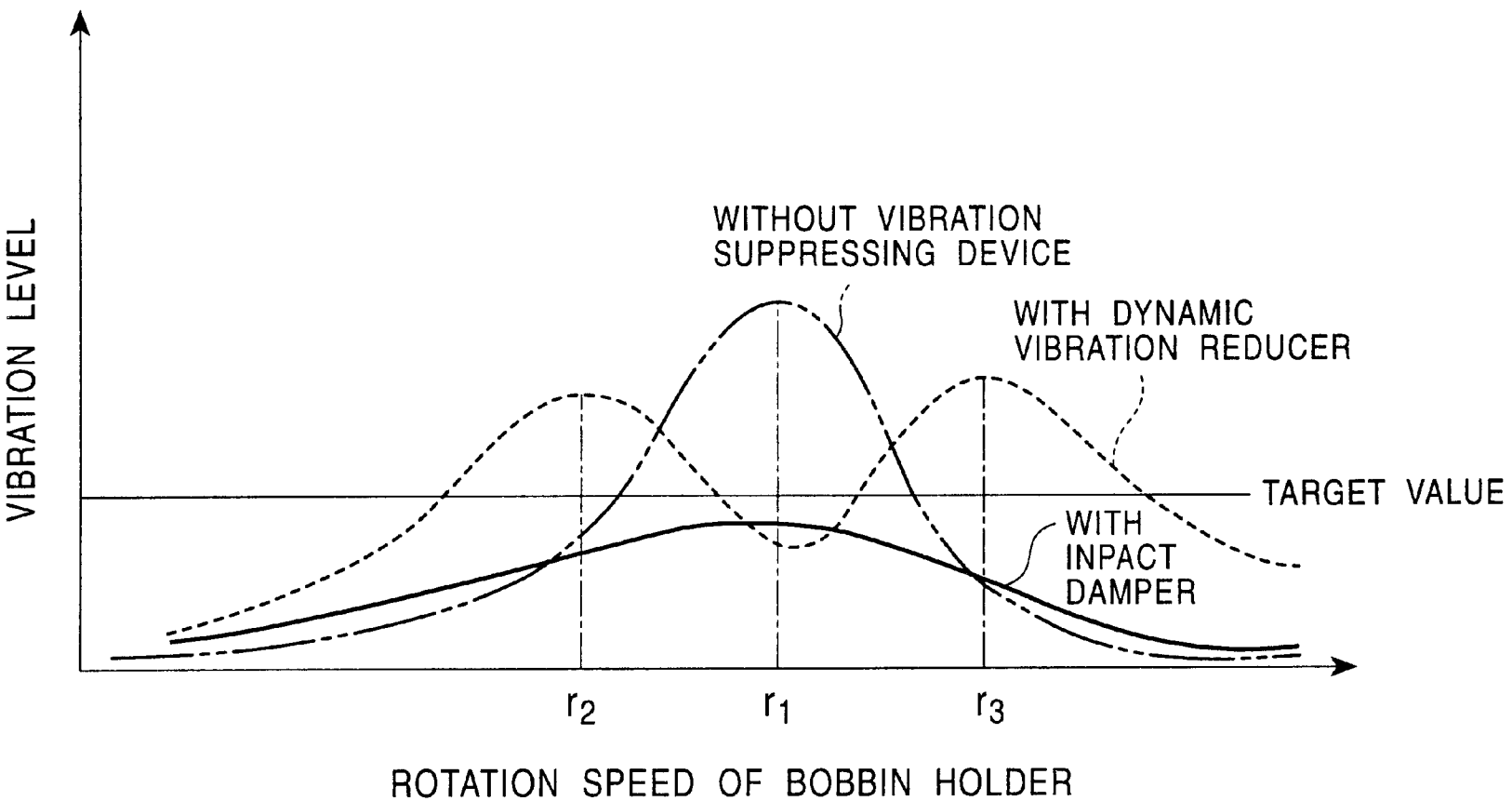
FIG. 3 is a graph showing a vibration absorption characteristic of an impact damper.

FIG. 3 shows a vibration absorption characteristic of the impact damper 10. A resonance point between the impact damper 10 and the bobbin holder is at a rotation speed r1 of the bobbin holder. Thus, without the damper 10, the vibration level is high at the rotation speed r1, as shown by the alternate one long and two short dashes line. With the impact damper 10, the collision level increases consistently with vibration level, so that the vibration energy is more easily converted into the thermal energy. Accordingly, the vibration level lowers significantly at the rotation speed r1, whereas the decrease rate is not so high where the vibration level is originally lower. The vibration level, however, can be reduced down to a target value or lower over a wide range of rotation speeds of the bobbin holder. On the other hand, with a dynamic vibration reducer constructed by combining a viscoelastic material and a mass, the vibration level lowers at the rotation speed r1 of the bobbin holder, whereas peaks of the vibration level occur at a rotation speed r2, which is lower than r1 and at a rotation speed r3, which is higher than r1. That is, the dynamic vibration reducer simply disperses the vibration energy, so that more vibration points are created. As a result, resonance occurs at the rotation speed r2 or r3 of the bobbin holder.

Figure 4:
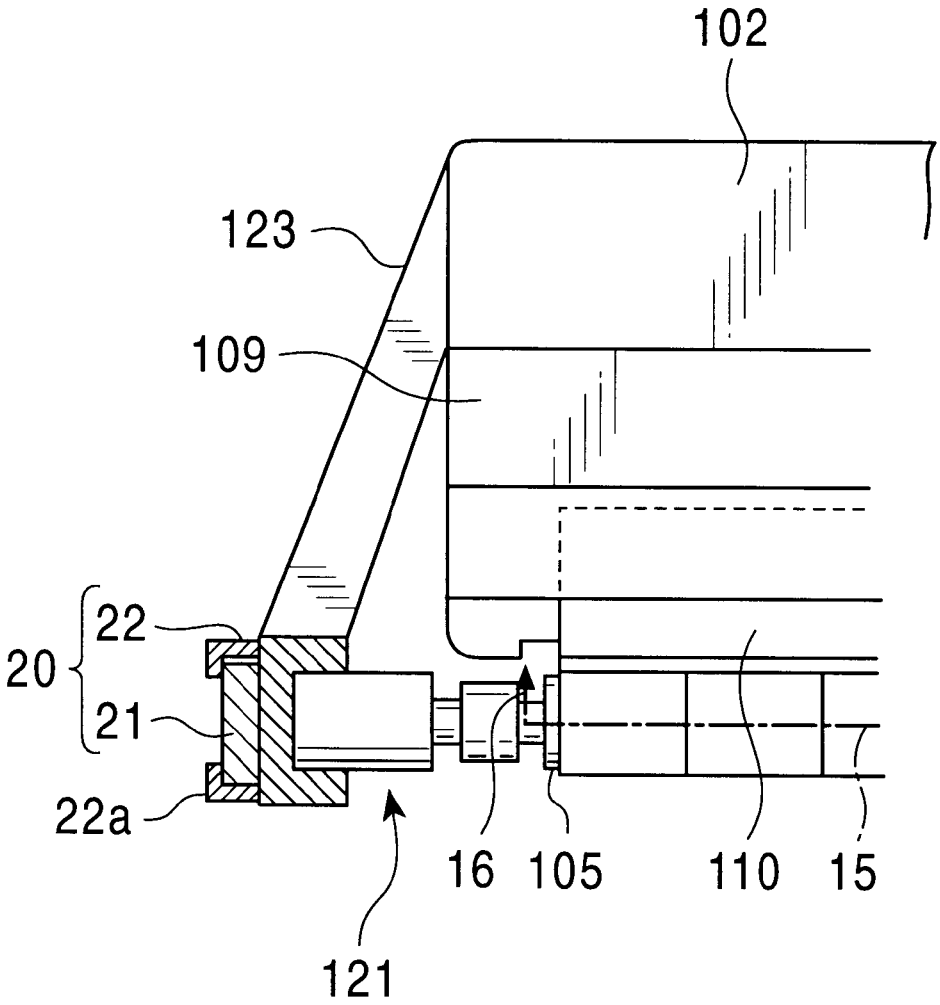
FIG. 4 is a partial side view of a take-up winder showing another embodiment of the present invention.

FIG. 4 shows an impact damper 20 provided at the tip of the bobbin holder 105 via a tip support device 121. The impact damper 20 comprises a disc 21 that is a mass body and a cylinder 22 for holding the disc 21. The cylinder 22 has an inner diameter larger than the outer diameter of the disc 21, so that there is a predetermined gap between the cylinder 22 and the disc 21. Accordingly, the disc 21 has appropriate degrees of freedom for moving in all two-dimensional directions in the plane 16 perpendicular to the rotational axis 15 of the bobbin holder 105. In addition, the cylinder 22 has a flange 22*a* acting as locking means to prevent the disc 21 from slipping out therefrom.

The tip support device 121 for the bobbin holder is held on a projected portion of the body frame 102 via an arm 123. The support device 121 must meet three conditions: it must be able to be arbitrarily installed on and removed from the bobbin holder 105, the vibration of the bobbin holder 105 must be transmitted thereto, and it must be stiff enough to hold the mounted impact damper 20. Next, the arm 123 for holding the support device 121 on the projected portion of the body frame 102 must meet two conditions: it must hold the support device 121 so as not to rotate around the bobbin holder 105 and it must prevent the support device 121 from slipping out in an axial direction of the bobbin holder 105 despite vibration.

Figure 5:
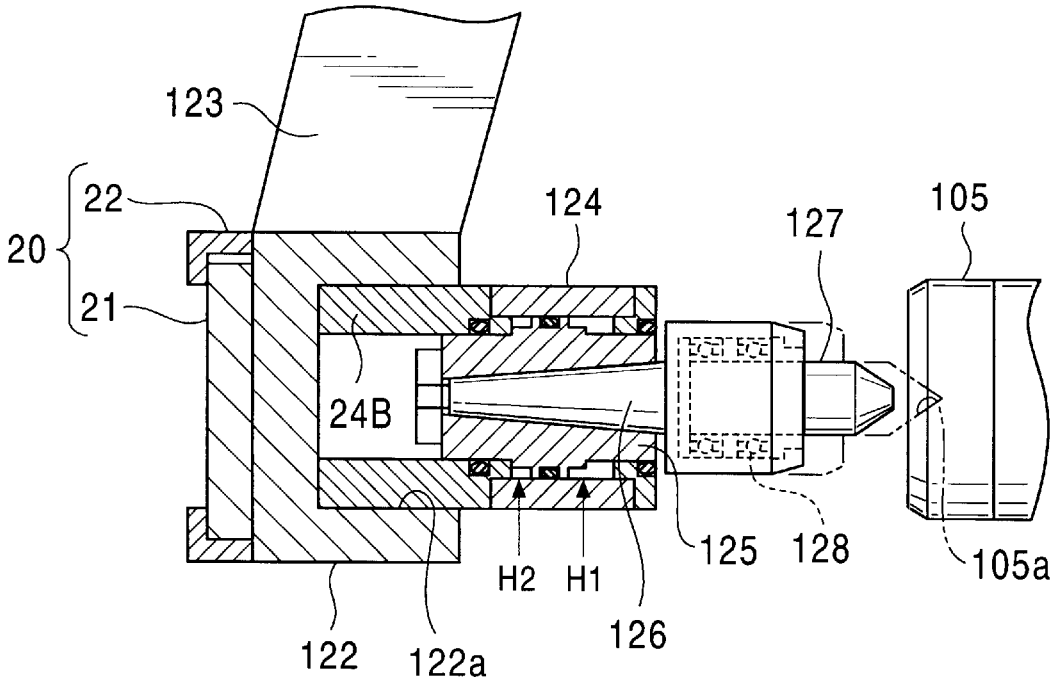
FIG. 5 is a sectional view of a vibration suppressing device section of the embodiment in FIG. 4.

An example of such a support device 121 is shown in FIG. 5. A cylinder 124 is fitted and fixed via a spacer 24B in a hole 122*a* in a holder 122, which is mounted in an arm 123. The holder 122 is held on the projected portion of the body frame 102 via the arm 123. The support device 121 may hold the holder 122 on a base of the body frame 102. The cylinder 124 has a piston 125 slidably inserted thereinto. The piston 125 has a corn 126 press-fitted therein, and the corn 126 has a support shaft 127 rotatably supported in a tip thereof by means of a bearing 128. The support shaft 127 has a conical tip that engages with a conical hole 105*a* in the tip of the bobbin holder 105. The above described cylinder 124 and piston 125 constitute a pneumatic actuator so that when compressed air is introduced into a port Hi, the piston 125 recedes to disengage the bobbin holder 105 from the support shaft 127. When compressed air is introduced into a port H2, the piston 125 advances to engage the bobbin holder 105 with the support shaft 127. Such a support shaft 127 can be freely engaged with and disengaged from the bobbin holder 105 at the winding position I. Thus, the bobbin holder 105 can be swiveled with the turret plate 104 during bobbin change, and the tip of the bobbin holder can be supported while the yarn is being wound.

In FIG. 4, the bobbin holder 105 vibrates in a plane 16 perpendicular to the central axis 15 thereof. The vibration is transmitted to the impact damper 20 through the support device 121 to vibrate the disc 21 in a radial direction of the cylinder 22. Then, a collision occurs repeatedly between the outer circumference of the disc 21 and the inner circumference of the cylinder 22. This collision converts the vibration energy into thermal energy to suppress the vibration.

Figure 6:
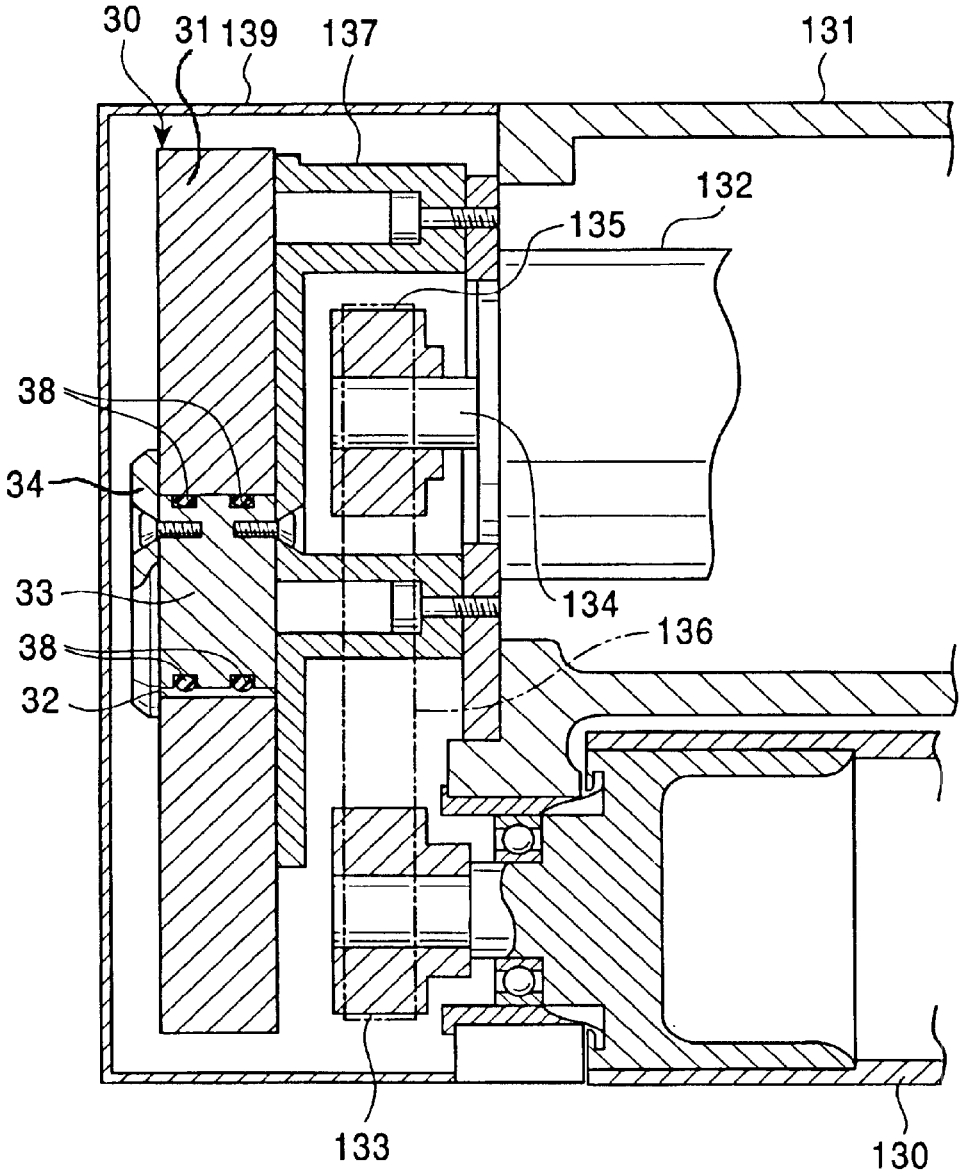
FIG. 6 is a partial sectional view showing yet another embodiment of the present invention.
Figure 7:
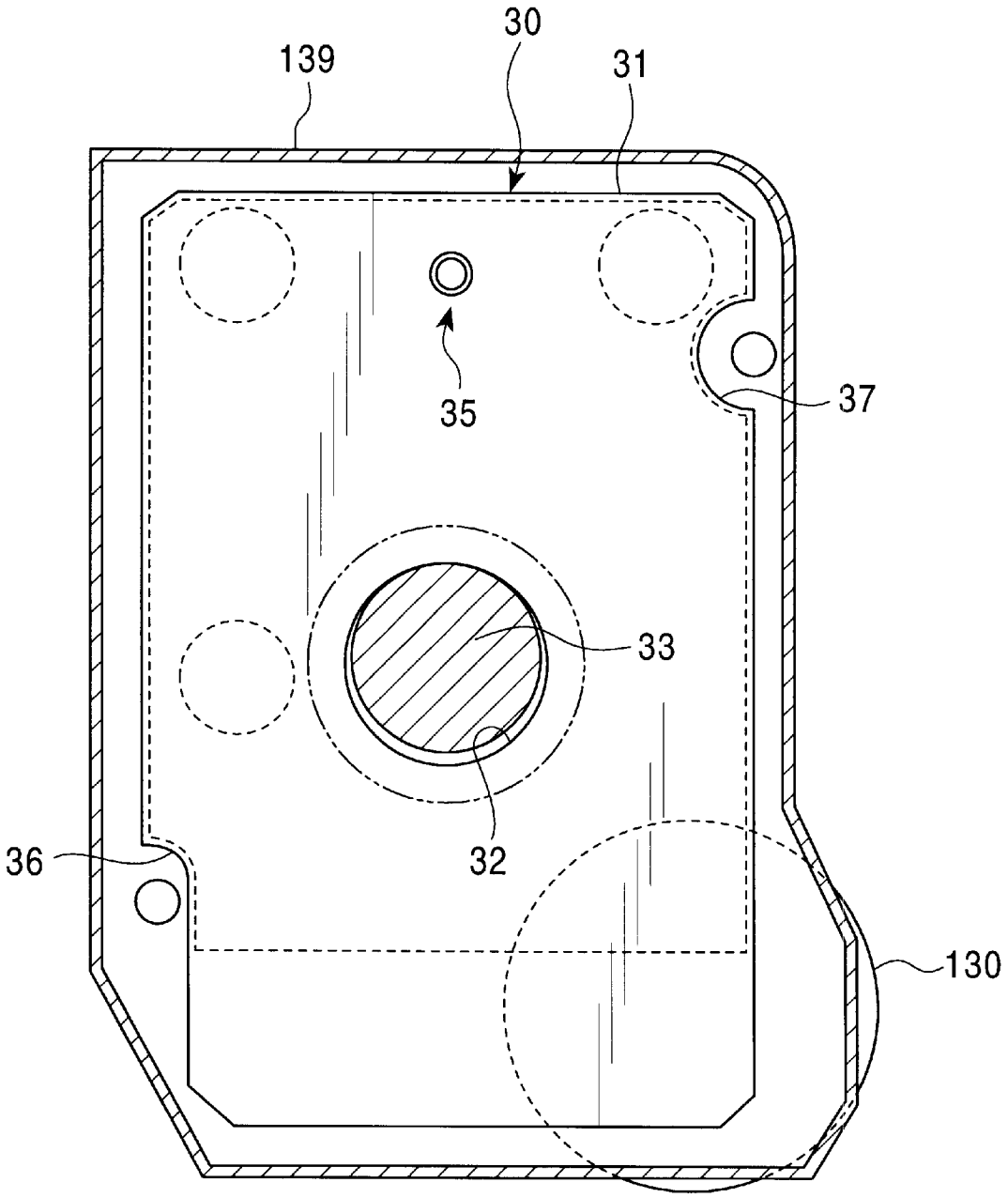
FIG. 7 is a partial front view of the embodiment in FIG. 6.

FIGS. 6 and 7 shows an impact damper 30 applied to a friction drive type take-up winder. The friction drive type take-up winder is used, for example, for elastic yarns. This take-up winder is structured to rotatably support on a bracket 131 a friction roller 130 corresponding to the touch roller and to also support on the bracket 131 a motor 132 for rotating the friction roller 130. A timing belt 136 is passed between a pulley 133 at a tip of the friction roller 130 and a pulley 135 fitted over a drive shaft 134 of the motor 132, so as to positively drive the friction roller 130. A raised pedestal 137 having pillars at positions that do not interfere with the pulley 133, 135 or the timing belt 136 is fixed to a tip of the bracket 131 with a bolt.

The pedestal 137 has mounted thereon the impact damper 30 comprising a deformed rectangular plate 31, a shaft 33 passed through a hole 32 formed at a centroid of the rectangular plate 31, and an end plate 34. The rectangular plate 31 constitutes a mass body for the impact damper 30, while the shaft 33 constitutes a regulation member for the impact damper 30. The shaft 33 is projected perpendicularly to the pedestal 137, and the rectangular plate 31 is sandwiched and held between the pedestal 137 and the end plate 34. The hole 32 has an inner diameter larger than the outer diameter of the shaft 33, so that there is a predetermined gap between the hole 32 and the shaft 33. Accordingly, the rectangular plate 31 has degrees of freedom in the direction of the gap, that is, in a plane perpendicular to the axis of the bobbin holder, so that a collision occurs repeatedly between an inner circumference of the hole 32 and an outer circumference of the shaft 33. The shaft 33 has two circumferential grooves in an outer circumference thereof, with an O-ring 38 fitted in each of the grooves as an elastic body. The O-rings 38 are provided to avoid shrill impact sounds. Even if the elastic body is interposed between the mass body and the regulation member in order to reduce impact sounds as described above, the elastic modulus of the elastic body must be specified so that vibration causes the mass body and the regulation member to collide against each other.

A cap 139 is mounted on an extension of the bracket 131, with the rectangular plate 31 accommodated therein. The rectangular plate 31 is prevented by a detent means 35 from coming in contact with the cap 139. In addition, to avoid interfering the other members and have maximized sizes by effectively utilizing an interior of the cap 139, the rectangular plate 31 has appropriate notches 36, 37. Thus, a heavy rectangular plate (massive body) 31 can be attached to the tip of the bracket 131, and the effectively operating impact damper 30 can be mounted without unnecessarily increasing the external dimensions of the take-up winder.

Figure 8:
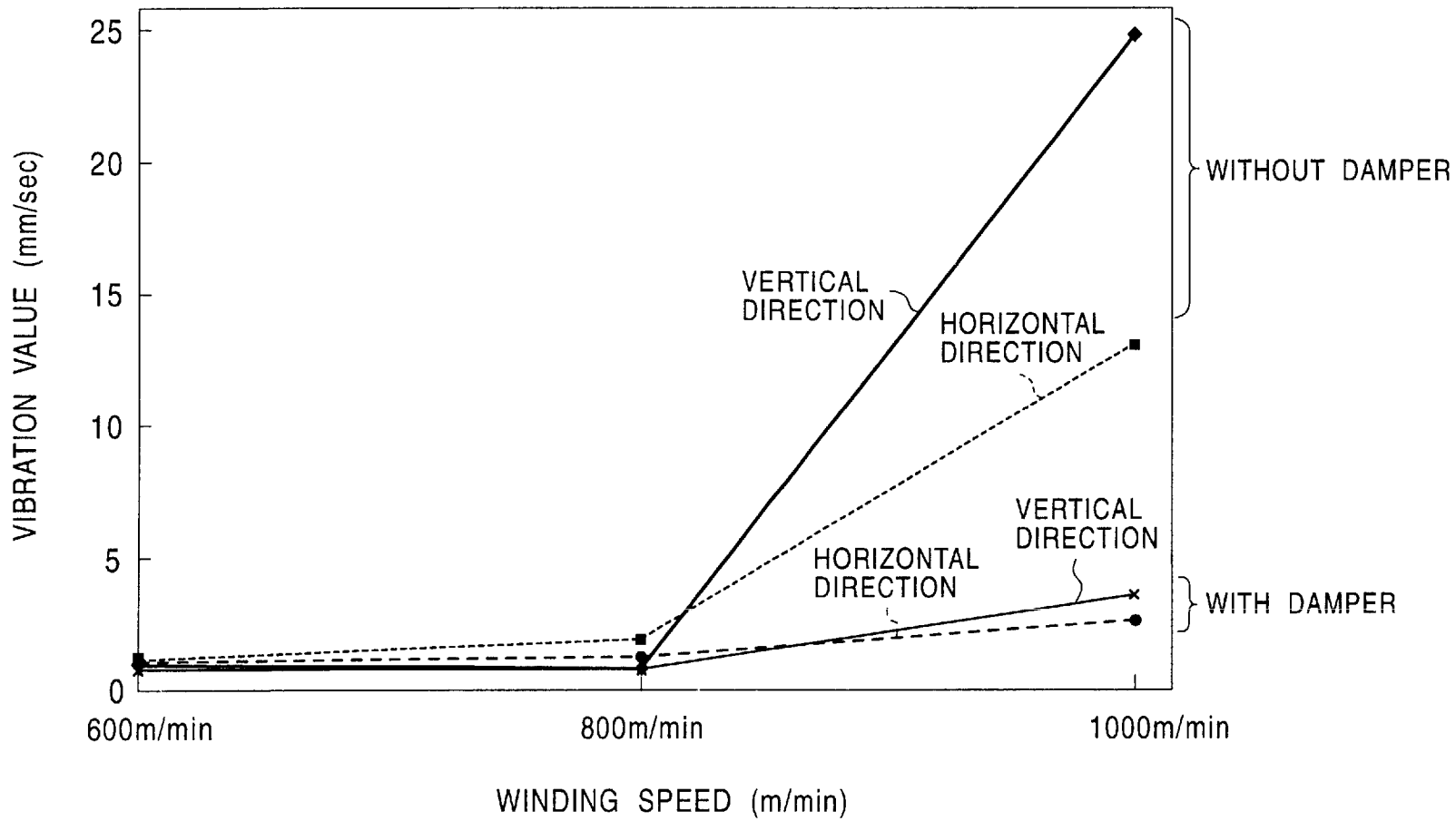
FIG. 8 is a graph showing a vibration suppressing effect according to the present invention.

FIG. 8 is a graph showing a vibration absorbing effect of the impact damper 30 in FIGS. 6 and 7. In the take-up winder used in experiments, the rotational frequency of the bobbin holder reached a resonance frequency during an initial winding phase when the yarn is wound around the bobbin at a winding speed of 1,000 m/min. This take-up winder was used, the winding speed was varied 600 m/min., 800 m/min. and 1000 m/min., and a vibration value (mm/sec.) was measured at the tip of the bracket 131 both in a vertical and horizontal directions during an initial winding phase. The hole 32 had an inner diameter of 42 mmϕ, the shaft 33 had an outer diameter of 41.4 mmϕ, and a gap of size 0.6 mm per side was formed between the hole 32 and the shaft 33. Additionally, the rectangular plate 31 had a weight of about 5 kg.

FIG. 8 indicates that the vibration suppressing effect of the impact damper is very high at a winding speed of 1,000 m/min., which is close to the resonance point. At a winding speed of 600 m/min. or 800 m/min., which is far from the resonance point, the vibration value is originally low but remains low when the impact damper is installed. This means that the impact damper can be used over a wide range of winding speeds.

The impact damper may be of a type in which granules such as metal powders are fluidally provided in a container. The granules in the container flow in the vibrating direction and collide repeatedly against one another to convert the vibration energy into thermal energy. Alternatively, as long as rotatable bobbin holders each having bobbins installed thereon and around which packages are formed are supported on a body frame, the present vibration suppressing device can be applied to various yarn winders, including the take-up winders. Alternatively, the impact damper may be provided in any site where the winder vibrates heavily, and the installation site is not particularly limited.

According to the present invention, the impact damper is provided in the site of the yarn winder which vibrates as the bobbin holder rotates. Consequently, the vibration suppressing function of the impact damper is provided despite differences among individual yarn winders or temporal changes, to suppress the vibration to a low level. In addition, the mass body and regulation member of the impact damper do not change temporally, so that the vibration suppressing function of the impact damper is stably provided over a long period.

According to the present invention, the degrees of freedom of the mass body are provided in the plane perpendicular to the rotational axis of the bobbin holder. Therefore, the vibration energy is efficiently absorbed.

According to the present invention, the mass body is held on the regulation member at its centroidal position, thereby allowing the impact damper to function effectively to prove a high vibration suppressing effect. Moreover, the size of the mass body can be maximized without increasing the size of the yarn winder.

What is claimed is:

1. A yarn winder comprising rotatable bobbin holders supported on a body frame, the bobbin holders each having bobbins installed thereon and around which packages are formed, the yarn winder being characterized in that an impact damper is provided in a site that vibrates as at least one of said bobbin holders is rotated, said impact damper comprising a regulation member and a mass body, wherein said regulation member is attached to the site that vibrates and said regulation member and said mass body collide against one another.

2. A yarn winder according to claim 1, characterized in that the degrees of freedom of said mass body are provided in a plane perpendicular to a rotational axis of said at least one of said bobbin holders.

3. A yarn winder according to claim 2, characterized in that said mass body is held on said regulation member at a centroidal position of said mass body.

4. A yarn winder according to any one of claims 1 to 3, characterized in that said regulation member holds said mass body in such a manner that the mass body has degrees of freedom in a plurality of directions.

5. A yarn winder according to any one of claims 1 to 3, characterized in that an elastic body is interposed between said mass body and said regulation member so that said mass body can collide against said regulation member.

6. A yarn winder according to any one of claims 1 to 3, characterized in that said impact damper is provided at a tip of said at least one of said bobbin holders.

7. A yarn winder according to any one of claims 1 to 3, characterized in that said at least one of said bobbin holders is supported in such a manner as to project from the body frame.

8. A yarn winder according to any one of claims 1 to 3, characterized in that the yarn winder has a touch roller in contact with the package on said at least one of said bobbin holders, a bracket supporting the touch roller is supported in such a manner as to project from the body frame, and said impact damper is provided on a tip surface of said bracket.

* * * * *